US005938473A

United States Patent [19]

Nishio et al.

[11] Patent Number: 5,938,473

[45] Date of Patent: Aug. 17, 1999

[54] ELECTRICAL CONNECTOR WITH VERTICAL LIFT PREVENTION MECHANISM

[75] Inventors: Atsushi Nishio; Yoshikazu Abe, both of Ibaraki-Ken, Japan

[73] Assignee: Mitsumi Electric Co., Ltd., Japan

[21] Appl. No.: 08/886,277

[22] Filed: Jul. 1, 1997

[30] Foreign Application Priority Data

Jul. 22, 1996 [JP] Japan ..... 28-10511

[51] Int. Cl.[6] ..... H01R 13/73

[52] U.S. Cl. ..... 439/567; 439/607

[58] Field of Search ..... 439/607, 609, 439/939, 95, 101, 108, 567, 680

[56] References Cited

U.S. PATENT DOCUMENTS 4,938,704 7/1990 Fujiura ..... 439/607

5,017,158 5/1991 Liu et al. ..... 439/609

5,755,595 5/1998 Davis et al. ..... 439/607

*Primary Examiner*—Gary Paumen

*Assistant Examiner*—Truc Nguyen

*Attorney, Agent, or Firm*—Morrison Law Firm

[57] ABSTRACT

An electrical connector has a main unit with and integral row of parallel connector pins. A first end of each connector pin is at a front of main unit and a second end is at a rear of main unit. Each parallel connector pin is bent downward toward the back so that they project downward from the bottom surface of main unit. A socket shield made from a thin plate surrounds the upper and lower surfaces and the two side surfaces of main unit. A pair of substrate fixing claws project downward from the sides of the lower surface at the rear of main unit. The socket shield also has an engagement piece projecting downward from the front region of the lower surface. The pair of substrate fixing claws and the engagement piece both engage the mounting substrate when the electrical connector is mounted on the mounting substrate.

22 Claims, 5 Drawing Sheets

ELECTRICAL CONNECTOR WITH VERTICAL LIFT PREVENTION MECHANISM

BACKGROUND OF THE INVENTION

The present invention relates to an electrical connector. More specifically, the present invention relates to an electrical connector mountable on a substrate and having connector pins for connection to various signal lines from a printed circuit on the substrate.

Connectors of this type include what are known as "USB connectors". Referring to FIG. 7 and FIG. 8, the structure of such a connector is shown. A conventional electrical connector (USB connector) 1 has a main unit 2 with a plurality (four, in the example shown in the drawings) of connector pins 3 disposed in a row along a bottom surface of main unit 2. Connector pins 3 have first ends at a front of main unit 2 and second ends toward the back of main unit 2. Connector pins 3 are bent downward toward the back so that they project downward from the bottom surface of main unit 2. Connector pins 3 are inserted integrally with main unit 2 and extend parallel to each other. A socket shield 4 having two substrate fixing claws 4*a* surrounds the upper and lower surfaces and the two side surfaces of main unit 2. Fixing claws 4*a* project downward from opposing sides of the lower surface of socket shield 4.

Main unit 2 is formed from an insulative material such as molded resin. Connector pins 3 are formed from a conductive material. Second ends of connector pins 3 that extend downward project downward from the bottom surface of main unit 2 and through socket shield 4. During mounting, second ends of connector pins 3 pass through holes disposed on a mounting substrate 5. Once connector pins 3 are positioned correctly, they are electrically connected by soldering connector pins 3 to the lower edge of the holes in mounting substrate 5. First ends of connector pins 3 are exposed within main unit 2 toward the front of main unit 2. When a connection plug (not shown) is inserted into electrical connector 1, the exposed ends of connector pins 3 make electrical contact with contact sections of the connection plug.

Socket shield 4 includes a thin plate material which is bent to surround main unit 2. When socket shield 4 is mounted on the substrate, its bottom surface contacts the upper surface of mounting substrate 5. Fixing claws 4*a* fit against an engagement section (not shown in the drawings) disposed on mounting substrate 5, thereby fixing socket shield 4 to mounting substrate 5.

The engagement of substrate fixing claw 4*a* with the engagement section of mounting substrate 5 fixes socket shield 4 and electrical connector 1 to mounting substrate 5. The second ends of connector pins 3 are soldered at the bottom end of the through hole on substrate 5. This provides an electrical connection with a circuit formed on the bottom surface of mounting substrate 5.

When electrical connector 1 mounted on mounting substrate 5 in this manner, a connector plug attached to the end of a connector cable is inserted from the front of main unit 2 so that contact points of the connector plug contact the first ends of connector pins 3. Thus, the contact points of the connector plug are electrically connected to the connecting sections formed on mounting substrate 5 via connector pins 3 of electrical connector 1.

However, in electrical connector 1 structured in this manner, the mechanical fixing and supporting on mounting substrate 5 is performed solely by the engagement of substrate fixing claw 4*a* of socket shield 4 and the engagement section disposed on mounting substrate 5. Thus, electrical connector 1 is fixed or supported to mounting substrate 5 toward the rear of socket shield 4, while there is no particular support toward the front of socket shield 4.

If an improper force is applied to electrical connector 1 during the insertion or removal of the connector plug, the front of socket shield 4 moves vertically, resulting in mechanical pinching. This results in a detrimental load being applied to substrate fixing claw 4*a* of socket shield 4 so that socket shield 4 is deformed or in the worst case, disengaged from mounting substrate 5. Repeated occurrences of the improper force being applied to electrical connector 1 shorten the useful life of the electrical connector since the mechanical pinching gradually wears substrate fixing claw 4*a* and mounting substrate 5. After a while, the mechanical connection between fixing claw 4*a* and mounting substrate 5 becomes loose and ineffective for holding electrical connector 1 in place.

OBJECTS AND SUMMARY OF THE INVENTION

It is an object of the present invention to overcome the drawbacks of the prior art.

It is another object of the present invention to provide an electrical connector with increased withstand capability against improper mechanical forces applied to it during insertion and removal of connectors.

It is another object of the present invention to provide an electrical connector in which no load is applied to a substrate fixing claw of a socket shield even if mechanical pinching takes place.

Briefly, an electrical connector has a main unit with and integral row of parallel connector pins. A first end of each connector pin is at a front of main unit and a second end is at a rear of main unit. Each parallel connector pin is bent downward toward the back so that they project downward from the bottom surface of main unit. A socket shield made from a thin plate surrounds the upper and lower surfaces and the two side surfaces of main unit. A pair of substrate fixing claws project downward from the sides of the lower surface at the rear of main unit. The socket shield also has an engagement piece projecting downward from the front region of the lower surface. The pair of substrate fixing claws and the engagement piece both engage the mounting substrate when the electrical connector is mounted on the mounting substrate.

According to an embodiment of the present invention, there is described an electrical connector, comprising: a main unit, a plurality of connector pins disposed parallel to each other in a row at a front of said main unit, bent portions of said plurality of connector pins being bent downward toward the back of said main unit; so that they project downward from a bottom surface of said main unit, said plurality of connector pins being inserted integrally with said main unit, a socket shield made from a thin plate surrounds said main unit, said socket shield having substrate fixing claws which project downward from the sides of the lower surface at the rear of said socket shield, said socket shield further includes an engagement piece projecting downward from a front region of said lower surface that engages a mounting substrate when said electric connector is mounted on said mounting substrate.

According to another embodiment of the present invention, there is described, an electrical connector, comprising: at least one connector pin having a first end and a second end, a main unit having a front end and a back end, said at least one connector pin integrally inserted in said main unit with said first end at said front end of said main unit and said second end at said back end of said main unit, a socket shield surrounding a top, a bottom and two opposing sides of said main unit, said socket shield having an opening providing access to said front end of said main unit, fixing claws on said two opposing sides of said socket shield and projecting downward, an engagement member connected to said bottom of said socket shield between said fixing claws and said front end, and said engagement member and said fixing claws engaging a mounting substrate when said electric connector is mounted on said mounting substrate.

According to another embodiment of the present invention, there is described, an electrical connector being mountable on a mounting substrate, comprising: an insulative main unit, at least one connector pin housed in said main unit, a socket shield made of a thin material formed around said main unit, an open front portion of said socket shield providing access to said main unit for the insertion of a plug designed to connect with said at least one connector pin, said socket shield including fixing members projecting downward on opposing sides of said socket shield near a back of said socket shield, an engagement piece including an extension of said thin material of said socket shield extending downward from a bend line on a bottom surface of said socket shield between said two engagement members and said front portion, and said two engagement members and said engagement piece engaging engagement surfaces of said mounting substrate when said electric connector is mounted on said mounting substrate.

In the present invention, the objects are achieved by an electrical connector comprising: a main unit made from mold resin; a plurality of connector pins disposed in a row at the front of the main unit, bent downward toward the back so that they project downward from the bottom surface of the main unit, inserted integrally with the main unit, and extending parallel to each other; a substrate fixing claw projecting downward from the bottom surface at the rear; a socket shield made from a thin plate; wherein: the socket shield projects downward from the front region of its bottom surface and comprises an engagement piece that can engage with the mounting substrate during mounting.

The engagement piece of the electrical connector of the present invention includes a skirt to maintain the socket shield at a prescribed height from the mounting substrate.

The socket shield of electrical connector of the present invention is bent so that it has a bend line at the middle of the bottom surface. The engagement piece is formed by bending the thin plate section on one side of the bend line.

In the electrical connector of the present invention, the socket shield has a bend line at the middle of the bottom surface, and the engagement piece is formed by bending the thin plate section on either side of the bend line downward.

According to the structure described above, the socket shield of the electrical connector has a substrate fixing claw at its rear region that fits with an engagement section disposed on the mounting substrate. An engagement piece disposed at the front region of the socket shield engages with another engagement section disposed on the mounting board. This results in the electrical connector being mechanically fixed to and supported by the mounting substrate. Thus, the socket shield and the electrical connector is fixed to and supported by the mounting substrate both at the front and the rear. If, for example, an improper force is applied to the front region of the electrical connector during insertion or removal of the connector plug, mechanical pinching would not cause the front region of the electrical connector to be lifted up from the mounting substrate. No load is applied to the substrate fixing claw on the socket shield of the electrical connector so that the electrical connector is prevented from being unexpectedly disengaged from the mounting substrate. This improves the reliability of the mounting.

In this case, the socket shield is fixed to and supported by the mounting substrate via the substrate fixing claw at the rear and the engagement piece at the front. Thus, the socket shield is connected to the ground on the mounting substrate via the substrate fixing claw and the engagement piece. This provides reliable grounding.

If the engagement piece comprises a skirt to maintain the socket shield at a prescribed height from the mounting substrate, this skirt keeps the bottom surface of the socket shield parallel to the mounting substrate. This improves the ease of performing the mounting operation.

If the socket shield is bent so that there is a bend line at the center of the bottom surface, and the engagement piece is formed by bending the thin plate downward on one side of the bend line, then the engagement piece is formed integrally with the socket shield. This reduces the number of required parts and thus limits increases in production costs.

If the socket shield is bent so that there is a bend line at the center of the bottom surface, and the engagement piece is formed by bending the thin plate downward on both sides of the bend line, then the engagement piece is formed integrally with the socket shield as described above. This keeps the number of parts down, and thus, limits increases in production costs. Furthermore, since the engagement piece is formed by bending the thin plate downward on both sides of the bend line, it is formed as a double layer. This results in the fixing and supporting performed by the engagement piece to the mounting substrate to be stronger and more reliable.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
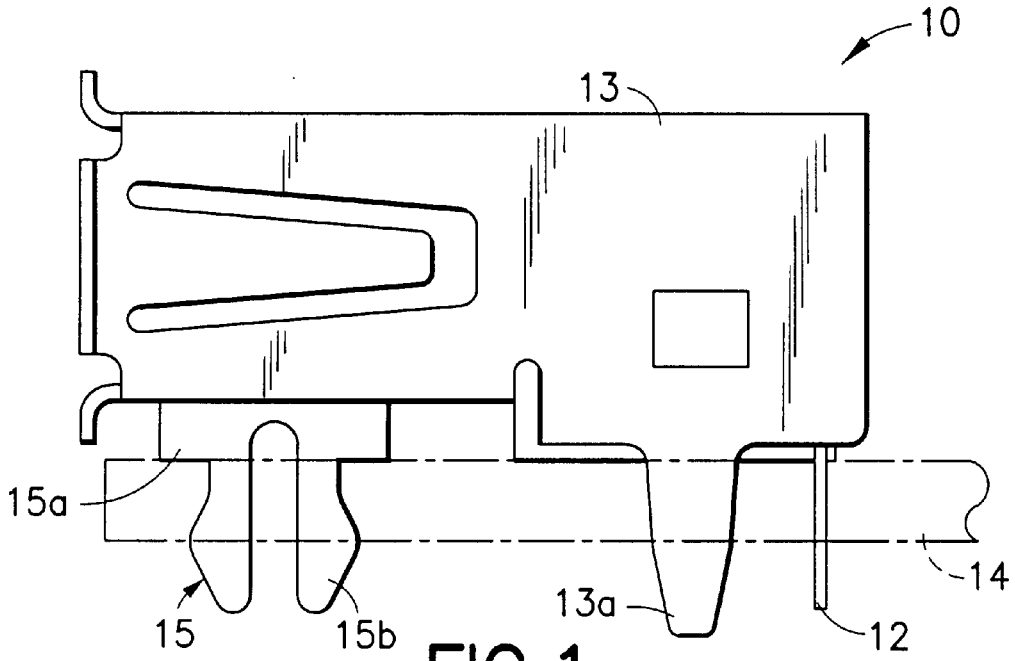
FIG. 1 is a side-view drawing showing an embodiment of the electrical connector of the present invention.
Figure 2:
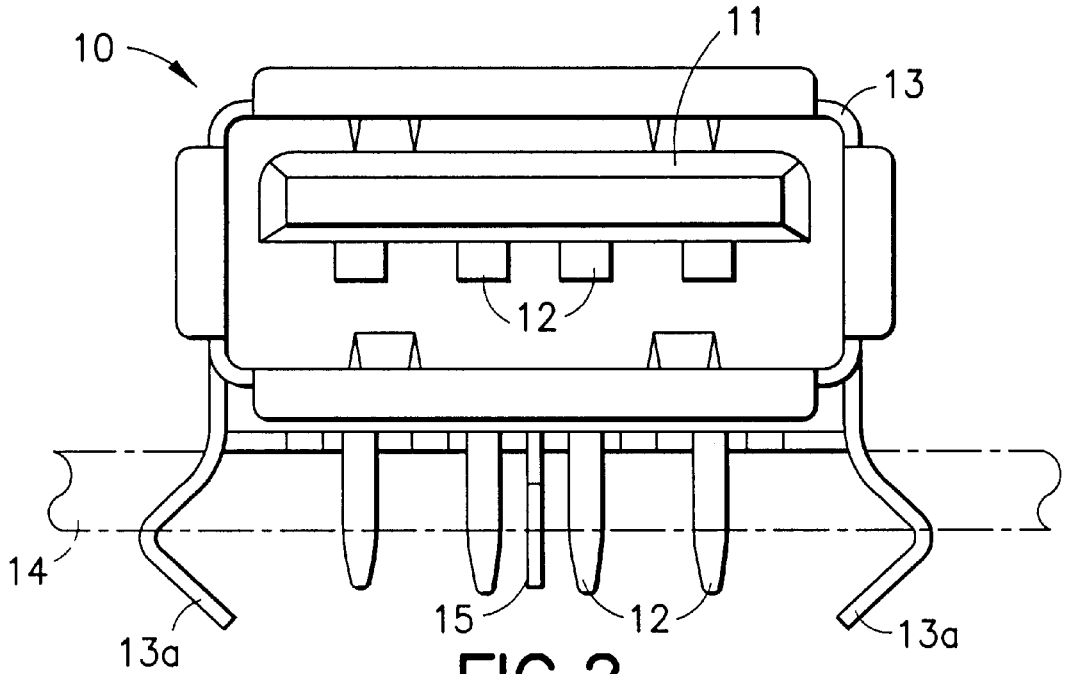
FIG. 2 is a front-view drawing of the electrical connector in FIG. 1.

Referring to FIGS. 1 and 2, an electrical connector 10 includes a main unit 11 with a plurality (four, in the example shown in the drawings) of connector pins 12 disposed in a row along a bottom surface of main unit 11. Connector pins 12 have first ends at a front of main unit 11 and second ends toward a back of main unit 11. Connector pins 12 are bent downward toward the back so that they project downward from the bottom surface of main unit 11. Connector pins 12 are inserted integrally with the main unit 11 and extend parallel to each other. A socket shield 13, having two substrate fixing claws 13*a,* surrounds the upper and lower surfaces and the two side surfaces of main unit 11. Fixing claws 13*a* project downward from the sides of the lower surface of socket shield 13, at the back of socket shield 13.

Figure 9:
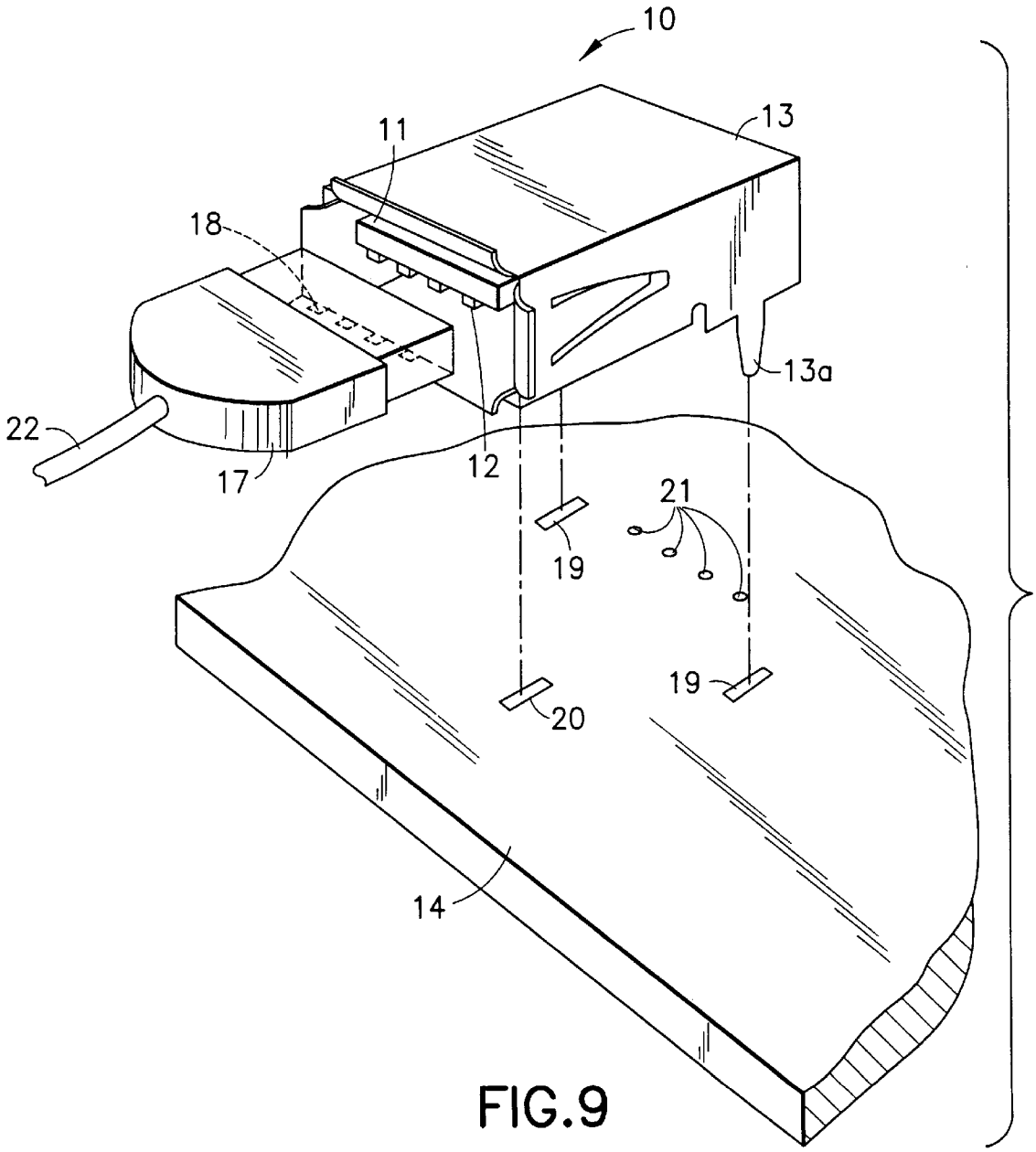
FIG. 9 is an exploded perspective view of the electrical connector and a connector plug being inserted therein.

Main unit 11 is formed from an insulative material such as molded resin. Connector pins 12 are formed from a conductive material. Second ends of connector pins 12 that extend downward project downward from the bottom surface of main unit 11 and through socket shield 13. During mounting, second ends of connector pins 12 pass through a hole disposed on a mounting substrate 14. Once connector pins 12 are positioned correctly, they are electrically connected by soldering connector pins 12 to the lower edge of holes in mounting substrate 14. First ends of connector pins 12 are exposed inside main unit 11 toward the front of main unit 11. Referring now also to FIG. 9, when a connector plug 17 is inserted into electrical connector 10, the exposed ends of connector pins 12 make electrical contact with contact points 18 of connection plug 17.

Figure 3:
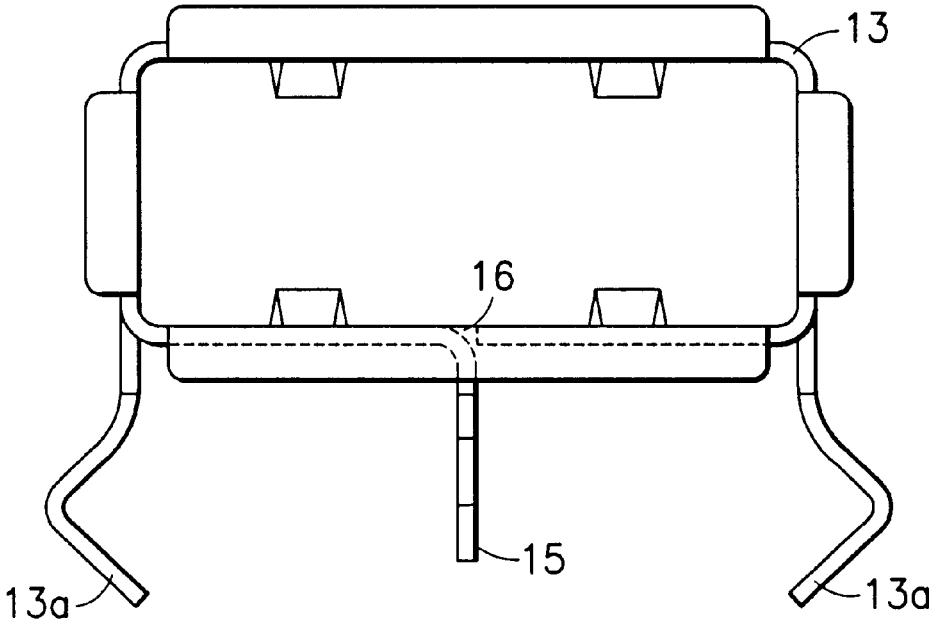
FIG. 3 is a front-view drawing of the socket shield of the electrical connector in FIG. 1.
Figure 4:
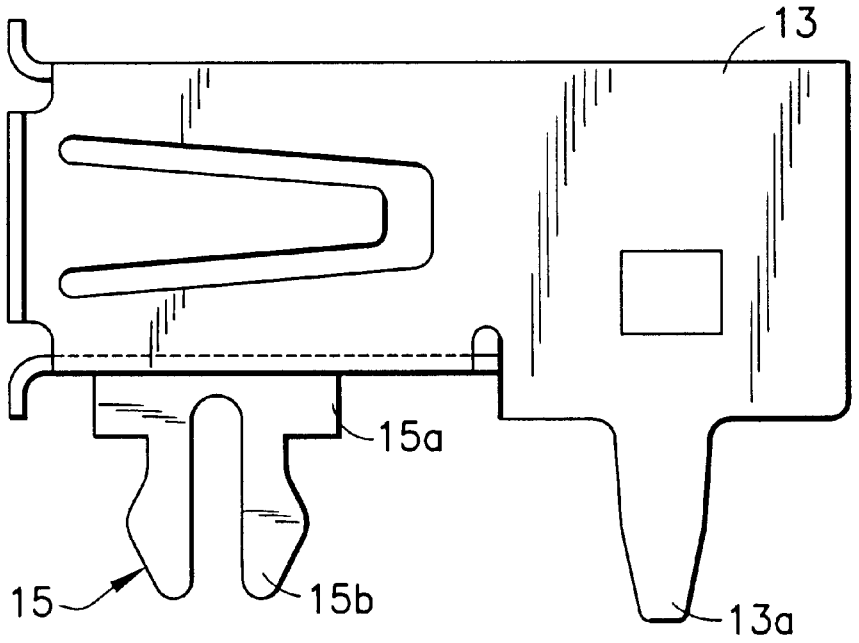
FIG. 4 is a side-view drawing of the socket shield in FIG. 3.

Referring to FIG. 3 and FIG. 4, socket shield 13 is formed by bending a thin plate material into the required shape. A bend line 16 extends longitudinally at a center of the bottom surface of socket shield 13. When mounted on mounting substrate 14, the bottom surface of socket shield 13 contacts the upper surface of mounting substrate 14. Two substrate fixing claws 13*a* are disposed on either side of the bottom surface near second ends of connector pins 12. Referring now also to FIG. 9, substrate fixing claws 13*a* fit against an engagement section 19 disposed on mounting substrate 14. Socket shield 13 is thereby fixed to and supported on mounting substrate 14.

Figure 7:
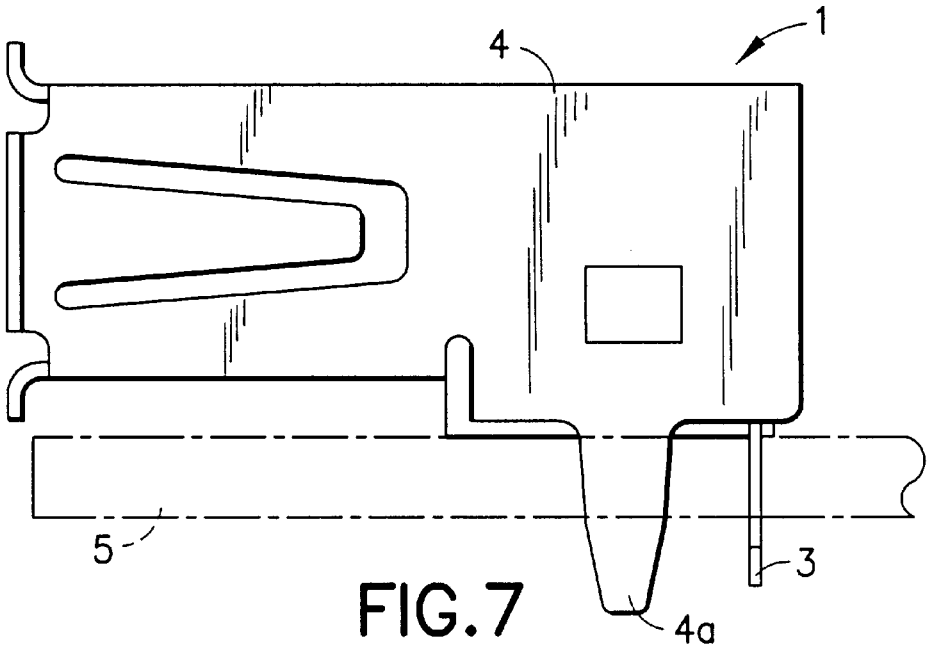
FIG.7 PRIOR ART
FIG. 7 is a side-view drawing showing an example of a prior art electrical connector.
Figure 8:
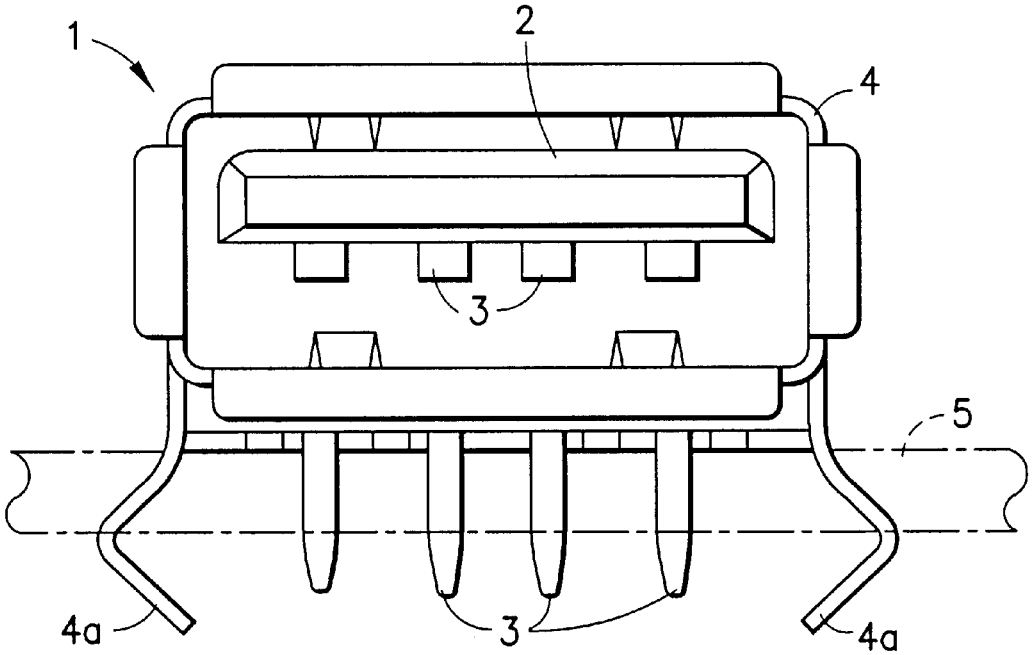
FIG.8 PRIOR ART
FIG. 8 is a front-view drawing of the prior art electrical connector shown in FIG. 7.

The above structure is the same as the conventional electrical connector 1, described with reference to FIGS. 7 and 8 above. However, in electrical connector 10 according to this embodiment of the present invention, socket shield 13 further includes an engagement piece 15 projecting downward from bend line 16 and toward the front of the lower surface of socket shield 13. Engagement piece 15 is formed integrally with socket shield 13 by bending the thin plate on one side of bend line 16 at the bottom surface of socket shield 13.

Referring now to FIGS. 1, 3, and 4, engagement piece 15 has a skirt 15*a* that contacts the upper surface of mounting substrate 14 when socket shield 13 is mounted parallel to mounting substrate 14. Engagement piece 15 further includes an engagement end 15*b* at a lower portion of engagement piece 15. Engagement end 15*b* is formed with split ends, similar to tines of a fork, so that it can be elastically deformed in a direction of bend line 16. The elastic deformation provides a more secure engagement between engagement piece 15 and mounting substrate 14.

Referring now also to FIG. 9, when electrical connector 10, as described above, is mounted onto mounting substrate 14, second ends of connector pins 12 are inserted into holes 21 disposed on mounting substrate 14. Substrate fixing claws 13*a* of socket shield 13 fit into engagement section 19 disposed on mounting substrate 14. The bottom surface of socket shield 13 is mounted onto the upper surface of mounting substrate 14 so that engagement piece 15, in the front region of socket shield 13, is engaged with another engagement section 20 disposed on mounting substrate 14. The second ends of connector pins 12 are electrically connected to the lower end of holes 21 on mounting substrate 14 providing electrical connections with a circuit (not shown) formed on the bottom surface of substrate 14. Substrate fixing claws 13*a* and engagement piece 15 are electrically connected to the engagement sections 19 and 20 and a ground pattern (not shown in the drawing) of mounting substrate 14, respectively. Substrate fixing claws 13*a* and engagement piece 15 provide a rigid mechanical connection between electrical connector 10 and mounting substrate 14. Engagement piece 15 prevents the mechanical pinching of electrical connector 10 associated with the application of an improper force to electrical connector 10.

With electrical connector 10 mounted on mounting substrate 14 in this manner, connector plug 17 attached to the end of a connector cable 22 is inserted into electrical connector 10 from the front of main unit 11. Contact points 18 positioned inside connector plug 17 contact first ends of connector pins 12 when connector plug 17 is inserted in electrical connector 10. Thus, contact points 18 of connector plug 17 form an electrical connection with contact sections of the circuit formed on mounting substrate 14 via connector pins 12 of electrical connector 10.

Substrate fixing claws 13*a* disposed on the rear region of socket shield 13 fit into engagement section 19 disposed on mounting substrate 14. Engagement piece 15 disposed on the front region engages another engagement section 20 disposed on mounting substrate 14. Both substrate fixing claws 13*b* and engagement piece 15 are soldered to mounting substrate 14 to provide a mechanical bond to mounting substrate 14.

In this manner, socket shield 13 and electrical connector 10 are fixed to and supported by mounting substrate 14 at the front and at the rear. Thus, if an improper force is applied to the front region of electrical connector 10 during insertion or removal of connector plug 17, the front region of electrical connector 10 will not lift up from mounting substrate 14. This eliminates the detrimental load on substrate fixing claws 13*a* caused by mechanical pinching, thus improving the reliability for the mounting of electrical connector 10.

Furthermore, socket shield 13 is grounded to mounting substrate 14 via substrate fixing claws 13*a* and engagement piece 15 so that the entirety of socket shield 13 is reliably grounded.

Socket shield 13 is made by bending one piece of thin plate material. Engagement piece 15 is formed by bending an extension of the thin piece along bend line 16. This reduces the number of required parts and also eliminates the need for parts to be attached. Thus, increases in production costs over the conventional electrical connector are avoided.

Figure 5:
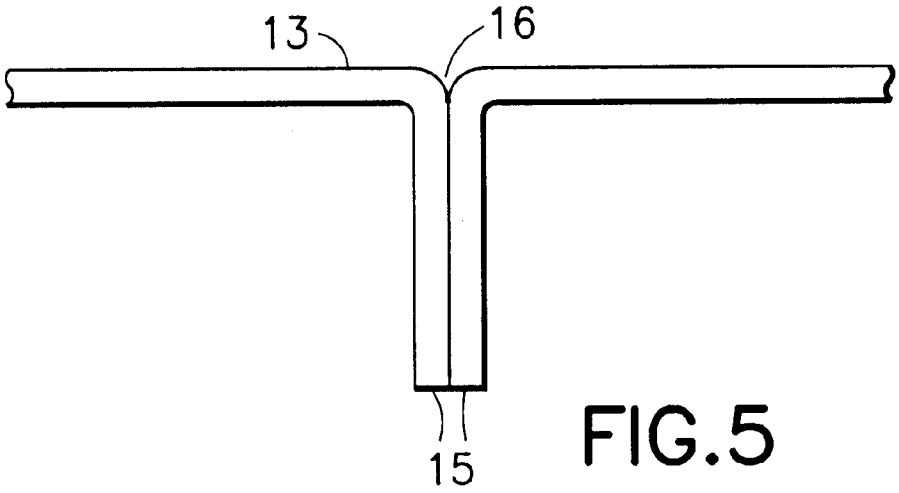
FIG. 5 is a partial front-view drawing showing a first alternative embodiment of the engagement section of the socket shield shown in FIG. 3.

Referring to FIG. 1 through FIG. 4, in socket shield 13 shown in the drawings, engagement piece 15 is formed by bending the thin plate on one side of bend line 16 at the center of the lower surface of socket shield 13. However, the present invention is not restricted to this structure. Referring to FIG. 5, it would also be possible to form engagement piece 15 by bending the thin plate on either side of bend line 16 at the center of the lower surface of socket shield 13. In this case, engagement piece 15 is formed as a double layer, thus increasing its rigidity and providing a connection with mounting substrate 14 that is stronger and more stable.

Figure 6:
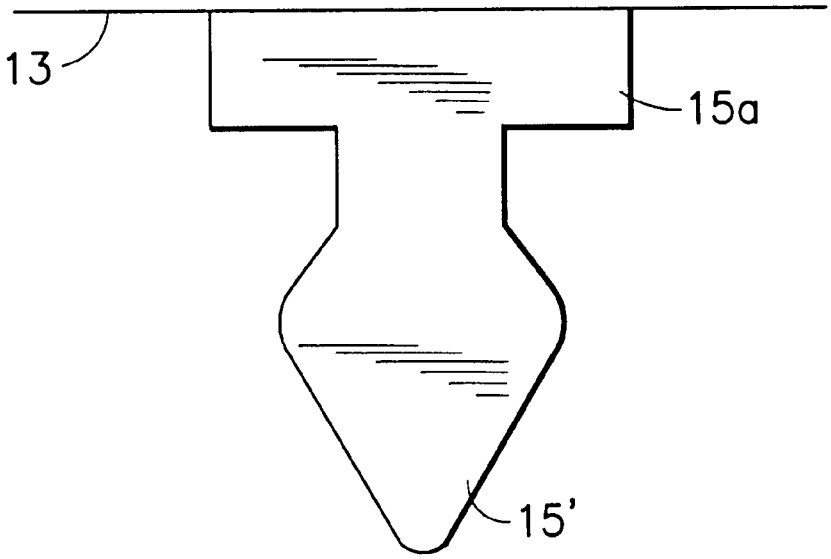
FIG. 6 is a partial side-view drawing showing a second alternative embodiment of the engagement section of the socket shield shown in FIG. 3.

In the embodiment described above, engagement piece 15 of socket shield 13 is formed with end 15*b* having split ends that provide elasticity. Referring to FIG. 6, engagement piece 15' can be formed so that it does not have elasticity. In this case, engagement piece 15' is pressed into another engagement section 20 disposed on mounting substrate 14 to provide bonding and support.

In the embodiment described above, an electrical connector having connector pins disposed in a single row along the front of the main unit was described. However, the present invention is not restricted to this structure. The present invention can also be implemented in electrical connector 10 having connector pins 12 disposed in two or more rows along the front of main unit 11.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

According to the present invention as described above, the socket shield of the electrical connector comprises a substrate fixing claw disposed on the rear region that fits against the engagement section disposed on the mounting substrate. Also, the engagement piece disposed on the front region engages another engagement section of the mounting substrate. This results in the socket shield being mechanically fixed to and supported by the mounting substrate. Thus, the socket shield and the electrical connector is fixed to and supported by the mounting substrate at the front and back. If an improper force is applied to the front region of the electrical connector during insertion or removal of the connector plug, the electrical connector does not lift up from the mounting substrate due to mechanical pinching. Thus, no load is applied to the substrate fixing claw of the socket shield of the electrical connector, and the electrical connector is prevented from being unexpectedly disengaged from the mounting substrate. This provides a more reliable mount.

Thus, according to the present invention, there is provided a superior electrical connector for which no load is applied to the substrate fixing claw of the socket shield even if mechanical pinching takes place.

What is claimed is:

1. An electrical connector comprising:

a main unit have a front mating face, a plurality of connector pins disposed parallel to each other in a row at a front of said main unit, a bend portion of said plurality of connector pins being bend downward toward a back of said main unit; so that they project downward from a bottom surface of said main unit;

said plurality of connector pins being inserted integrally with said main unit;

a socket shield made from a thin plate surrounds said main unit;

said socket shield having substrate fixing claws which project downward from the side of a lower surface at a rear of said socket shield, said rear of said socket shield is located at said back of said main unit;

said socket shield further includes an engagement piece projecting downward from a front region of said lower surface adjacent to said front mating face that engages a mounting substrate when said electric connector is mounted on said mounting substrate.

2. An electrical connector as described in claim 1 wherein said engagement piece includes a skirt which rests on said mounting substrate when said electrical connector is mounted on said mounting substrate to maintain said socket shield at a prescribed height from said mounting substrate.

3. An electrical connector as described in claim 1 wherein:

said socket shield is bent with a bend line at a center of said lower surface; and said engagement piece is formed by bending said thin plate on one side of said bend line downward.

4. An electrical connector as described in claim 1 wherein:

said socket shield is bent with a bend line at a center of said lower surface; and said engagement piece is formed by bending said thin plate on both sides of said bend line downward.

5. An electrical connector, comprising:

at least one connector pin having a first end and a second end;

a main unit having a front end and a back end;

said at least one connector pin integrally inserted in said main unit with said first end at said front end of said main unit and said second end at said back end of said main unit;

a socket shield surrounding a top, a bottom and two opposing sides of said main unit, said socket shield having an opening providing access to said front end of said main unit;

fixing claws on said two opposing sides of said socket shield and projecting downward;

an engagement member connected to said bottom of said socket shield between said fixing claws and said front end; and said engagement member and said fixing claws engaging a mounting substrate when said electric connector is mounted on said mounting substrate.

6. The electric connector of claim 5, wherein said engagement member has split ends which elastically deform when engaged with said mounting substrate.

7. The electric connector of claim 6, wherein said engagement member includes a skirt which rests on said mounting substrate when said engagement member is engaged with said mounting substrate.

8. The electric connector of claim 5, wherein said engagement member includes a skirt which rests on said mounting substrate when said engagement member is engaged with said mounting substrate.

9. The electric connector of claim 5, wherein:

said socket shield is made of a thin material having a bend line along a bottom of said socket shield; and said engagement member is an extension of said thin material bent down at said bend line.

10. The electric connector of claim 9, wherein said engagement member has split ends which elastically deform when engaged with said mounting substrate.

11. The electric connector of claim 10, wherein said engagement member includes a skirt which rests on said mounting substrate when said engagement member is engaged with said mounting substrate.

12. The electric connector of claim 9, wherein said engagement member includes a skirt which rests on said mounting substrate when said engagement member is engaged with said mounting substrate.

13. The electric connector of claim 5, wherein:

said socket shield is made of a thin material having a bend line along a bottom of said socket shield; and said engagement member is formed from two extensions of said thin material bent down at said bend line.

14. An electrical connector being mountable on a mounting substrate, comprising:

an insulative main unit;

at least one connector pin housed in said main unit;

a socket shield made of a thin material formed around said main unit;

an open front portion of said socket shield providing access to said main unit for the insertion of a plug designed to connect with said at least one connector pin;

said socket shield including fixing members projecting downward on opposing sides of said socket shield near a back of said socket shield;

an engagement piece including an extension of said thin material of said socket shield extending downward from a bend line on a bottom surface of said socket shield between said two fixing members and said front portion; and said two fixing members and said engagement piece engaging engagement surfaces of said mounting substrate when said electric connector is mounted on said mounting substrate.

15. The electrical connector of claim 14, wherein said engagement piece is fixedly connected to said mounting substrate, whereby a vertical movement of said front portion of said socket shield relative to said mounting substrate is prevented.

16. The electrical connector of claim 14, wherein said engagement piece has split ends which elastically deform when said engagement piece is mounted in said mounting surface.

17. The electrical connector of claim 16, wherein said engagement piece has a skirt which rests on said mounting substrate when said electrical connector is mounted on said mounting substrate, whereby said socket shield is maintained at a prescribed height above said mounting substrate.

18. The electrical connector of claim 14, wherein said engagement piece has a skirt which rests on said mounting substrate when said electrical connector is mounted on said mounting substrate, whereby said socket shield is maintained at a prescribed height above said mounting substrate.

19. The electrical connector of claim 14, wherein said engagement piece includes two extensions of said thin material.

20. The electrical connector of claim 19, wherein said engagement piece has split ends which elastically deform when said engagement piece is mounted in said mounting surface.

21. The electrical connector of claim 20, wherein said engagement piece has a skirt which rests on said mounting substrate when said electrical connector is mounted on said mounting substrate, whereby said socket shield is maintained at a prescribed height above said mounting substrate.

22. The electrical connector of claim 19, wherein said engagement piece has a skirt which rests on said mounting substrate when said electrical connector is mounted on said mounting substrate, whereby said socket shield is maintained at a prescribed height above said mounting substrate.

* * * * *